US010631571B2

(12) United States Patent
Malgat et al.

(10) Patent No.: US 10,631,571 B2
(45) Date of Patent: Apr. 28, 2020

(54) SMOKING ARTICLE WITH COMBUSTIBLE HEAT SOURCE GRIPPING MEANS

(71) Applicant: Philip Morris Products S.A., Neuchatel (CH)

(72) Inventors: Alexandre Malgat, Les Tuileries de Grandson (CH); Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/560,167

(22) PCT Filed: Mar. 30, 2016

(86) PCT No.: PCT/EP2016/056951
§ 371 (c)(1),
(2) Date: Sep. 21, 2017

(87) PCT Pub. No.: WO2016/156424
PCT Pub. Date: Oct. 6, 2016

(65) Prior Publication Data

US 2018/0077966 A1 Mar. 22, 2018

(30) Foreign Application Priority Data

Mar. 31, 2015 (EP) ..... 15162073

(51) Int. Cl.
*A24F 13/00* (2006.01)
*A24F 47/00* (2020.01)

(52) U.S. Cl.
CPC ..... *A24F 47/006* (2013.01)

(58) Field of Classification Search
CPC ..... A24F 47/00
USPC ..... 131/328–329
See application file for complete search history.

(56) References Cited

U.S. PATENT DOCUMENTS 3,228,402 A * 1/1966 Lebert ..... A24D 1/02 131/336
5,040,552 A 8/1991 Schleich et al.
5,595,577 A 1/1997 Bensalem et al.
8,616,217 B2 12/2013 Tsurizumi et al.
(Continued)

FOREIGN PATENT DOCUMENTS

CN 1039710 A 2/1990
CN 1040496 A 3/1990
(Continued)

OTHER PUBLICATIONS

International Search Report and Written Opinion dated Jun. 20, 2016 in PCT/EP2016/056951, filed Mar. 30, 2016.
(Continued)

*Primary Examiner* — Phuong K Dinh
(74) *Attorney, Agent, or Firm* — Oblon, McClelland, Maier & Neustadt, L.L.P.

(57) ABSTRACT

A smoking article is provided, including a combustible heat source; an aerosol-forming substrate downstream of the combustible heat source; a wrapper circumscribing the aerosol-forming substrate and at least a rear portion of the combustible heat source; and a plurality of inwardly extending sharp teeth fixed to an inner surface of the wrapper and arranged to grip the combustible heat source.

17 Claims, 7 Drawing Sheets

(56) References Cited

U.S. PATENT DOCUMENTS

| | | | | |
|---|---|---|---|---|
| 2013/0019888 | A1* | 1/2013 | Tsuruizumi | A24B 15/165 131/331 |
| 2014/0123992 | A1 | 5/2014 | Thomas et al. | |
| 2018/0116275 | A1* | 5/2018 | Malgat | A24D 1/02 |

FOREIGN PATENT DOCUMENTS

| | | | |
|---|---|---|---|
| CN | 1216903 | A | 5/1999 |
| CN | 1290131 | A | 4/2001 |
| EA | 015651 | B1 | 10/2011 |
| EP | 2 550 879 | A1 | 1/2013 |
| RU | 2 173 072 | C1 | 9/2001 |
| TW | 201134408 | A1 | 10/2011 |
| WO | WO 2009/022232 | A2 | 2/2009 |
| WO | WO 2013/162028 | A1 | 10/2013 |
| WO | WO 2014/086998 | A1 | 6/2014 |
| WO | WO 2015/022321 | A1 | 2/2015 |

OTHER PUBLICATIONS

Search Report dated Mar. 28, 2019 in the corresponding Russian Patent Application No. 2017135277 with English Translation 4 pages.

Chinese Office Action with English translation dated Dec. 18, 2019 in corresponding Chinese Patent Application No. 201680016627.3, (15 pages).

* cited by examiner

SMOKING ARTICLE WITH COMBUSTIBLE HEAT SOURCE GRIPPING MEANS

The present invention relates to a smoking article having a combustible heat source for heating an aerosol-forming substrate, a wrapper circumscribing the aerosol-forming substrate and at least a rear portion of the combustible heat source and gripping means on the wrapper for gripping the combustible heat source.

A number of smoking articles in which tobacco is heated rather than combusted have been proposed in the art. An aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate, such as tobacco. The aerosol-forming substrate may, be located within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. The combustible heat source and the aerosol-forming substrate are in abutting coaxial alignment and, along with the heat-conducting element, are overwrapped in an outer wrapper of cigarette paper of low air permeability to hold the various components of the smoking article together. In use, the front portion of the aerosol-forming substrate is heated primarily by conduction through the abutting rear portion of the combustible heat source and via the heat-conducting element.

In smoking articles in which tobacco is heated rather than combusted, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to a user. In some cases, the combustible heat source may become dislodged such that its position relative to the aerosol-forming substrate is altered. This may cause the temperature of the aerosol-forming substrate to drop outside of a desired range, thereby impacting the performance of the smoking article. If the temperature of the aerosol-forming substrate drops too low, for instance, it may adversely impact the consistency and the amount of aerosol delivered to a user.

To overcome these problems, it is known to apply glue between the combustible heat source and the outer wrapper or heat-conducting element to maintain the correct position of the combustible heat source relative to the aerosol-forming substrate. However, the addition of glue increases manufacturing complexity and cost and may have a detrimental effect on the appearance of the smoking article, for example by causing discolouration of the outer wrapper.

EP-A1-2 550 879 discloses a smoking article with a holder part for maintaining the correct position of the combustible heat source. The smoking article includes a multilayered tube member, a combustible heat source arranged in an end portion of the tube member and a smoking flavour releasing source arranged in the tube member and adjoining the heat source. The holder part is formed by locally deforming the tube to reduce its inner diameter such that it is less than the outer diameter of the combustible heat source. However, deforming the tube such that its inner diameter is less than the outer diameter of the heat source may lead to high levels of transverse forces being exerted on the outer surface of the heat source, which could cause breakage of the combustible heat source.

It would be desirable to provide an improved smoking article comprising a combustible heat source with improved integrity.

According to the present invention, there is provided a smoking article comprising a combustible heat source; an aerosol-forming substrate downstream of the combustible heat source; a wrapper circumscribing the aerosol-forming substrate and at least a rear portion of the combustible heat source; and gripping means on the wrapper for gripping the combustible heat source, the gripping means comprising a plurality of inwardly extending sharp teeth fixed to an inner surface of the wrapper and arranged to grip the combustible heat source.

As used herein, the term "sharp teeth" refers to projections which terminate at an edge, point, corner, or other similar structure, at which one or more surfaces converge to form an angular interface.

Advantageously, the plurality of inwardly extending sharp teeth increase the grip applied to the combustible heat source to maintain its position relative to the wrapper and the aerosol-forming substrate without the need for glue, or for high levels of transverse forces to be exerted on the outer surface of the heat source. Thus, the present invention may provide a smoking article which has improved integrity, which is simple to manufacture and which is less likely to be damaged during manufacture, transport or use.

As used herein, the terms "grip" and "gripping" are used to mean holding such that relative movement between two components of the smoking article; such as the wrapper and the combustible heat source, is resisted. Thus, a "gripping means" is one which resists relative movement between two components of the smoking article, such as the wrapper and the combustible heat source.

As used herein, the term "on the wrapper" is used to mean that the gripping means is fastened to the wrapper either as an integral part of the wrapper, or non-integrally as one or more discrete components which are fastened to the wrapper directly, or indirectly via one or more intermediate components.

In some embodiments, the plurality of inwardly extending sharp teeth terminate at a sharp edge formed from two or more surfaces which converge to form an angular interface. In other embodiments, the plurality of inwardly extending sharp teeth are pointed. That is, the plurality of inwardly extending sharp teeth may each terminate at sharp tip formed from one or more surfaces which converge in two dimension to form an angular interface.

As used herein, the terms 'upstream' and 'front', and 'downstream' and 'rear', are used to describe the relative positions of components, or portions of components, of the smoking article in relation to the direction in which a user draws on the smoking article during use thereof. Smoking articles according to the invention comprise a proximal end through which, in use, an aerosol exits the smoking article for delivery to a user. The proximal end of the smoking article may also be referred to as the mouth end. In use, a user draws on the mouth end of the smoking article in order to inhale an aerosol generated by the smoking article.

The combustible heat source is located at or proximate to the distal end of the smoking article. The mouth end of the smoking article is downstream of the distal end of the smoking article. The proximal end of the smoking article may also be referred to as the downstream end of the smoking article and the distal end of the smoking article may also be referred to as the upstream end of the smoking article. Components, or portions of components, of the smoking article may be described as being upstream or downstream of one another based on their relative positions between the proximal end of the smoking article and the distal end of the smoking article. The mouth end is downstream of the distal end.

The front end face of the combustible heat source is at the upstream end of the combustible heat source. The upstream end of the combustible heat source is the end of the combustible heat source furthest from the proximal end of the smoking article. The rear end face of the combustible heat source is at the downstream end of the combustible heat source. The downstream end of the combustible heat source is the end of the combustible heat source closest to the proximal end of the smoking article.

As used herein, the terms 'longitudinal' and 'axial' are used to describe the direction between the opposed front and rear end faces of the combustible heat source and the proximal end and the opposed distal end of the smoking article.

As used herein, the term 'length' is used to describe the maximum dimension in the longitudinal direction of a component of the smoking article, such as the combustible heat source, or of the smoking article itself. That is, the maximum dimension in the direction between the opposed front and rear end faces of the component, or the proximal end and the opposed distal end of the smoking article.

As used herein, the terms 'radial' and 'transverse' are used to describe the direction perpendicular to the longitudinal direction. That is, the direction perpendicular to the direction between the opposed front and rear end faces of the combustible heat source and the proximal end and the opposed distal end of the smoking article.

As used herein, the terms "inner surface" and "outer surface" refer to the radially inner and radially outer surfaces, respectively, of a component of the smoking article.

As used herein, the term 'diameter' denotes the maximum dimension in the transverse direction of a component of the smoking article, such as the combustible heat source, or of the smoking article itself.

The plurality of inwardly extending sharp teeth may extend inwardly in a substantially transverse direction. Alternatively, or in addition, at least some of the plurality of inwardly extending sharp teeth may extend towards an upstream end of the smoking article.

Preferably, at least some of the plurality of inwardly extending sharp teeth extend towards a downstream end of the smoking article. Advantageously, by extending towards a downstream end of the smoking article, the plurality of inwardly extending sharp teeth can act as barbs to increase resistance against upstream movement of the combustible heat source relative to the wrapper. This may also result in a reduced resistance to downstream movement of the combustible heat source, which can enable the combustible heat source to be more easily inserted into the upstream end of the smoking article during manufacture, if the combustible heat source is provided after the wrapper has been wrapped around the aerosol-forming substrate.

In certain preferred embodiments, substantially all of the plurality of inwardly extending sharp teeth extend towards a downstream end of the smoking article.

As used herein, the term "extend towards the downstream end of the smoking article" is used to mean that the tooth is arranged such that its tip is downstream of its base.

One or more of the plurality of inwardly extending sharp teeth may have a linear profile. That is, one or more of the plurality of inwardly extending sharp teeth may extend along a substantially straight line. Alternatively, or in addition, one or more of the plurality of inwardly extending sharp teeth may have a non-linear profile. That is, one or more of the plurality of inwardly extending sharp teeth may extend along a line which is not substantially straight. For example, one or more of the plurality of inwardly extending sharp teeth may have a curved profile. Where a tooth is non-linear, it may be formed from one or more linear or curved sections.

The plurality of inwardly extending sharp teeth may be arranged such that their respective free ends, or tips, extend in any suitable direction. For example, the tips of at least some of the plurality of inwardly extending sharp teeth may extend towards an upstream or downstream end of the smoking article. In certain embodiments, at least some of the plurality of inwardly extending sharp teeth extend towards the downstream end of the smoking article and have tips which also extend towards the downstream end of the smoking article. Such teeth may be linear or non-linear. In certain embodiments, the tips of at least some of the plurality of inwardly extending sharp teeth extend in a substantially transverse direction. With such an arrangement, the gripping means can provide increased resistance to relative movement of the combustible heat source and the wrapper in both the upstream and downstream directions. This may be of particular benefit in smoking articles in which the downstream movement of the combustible heat source is not prevented by other components of the smoking article, for example where the combustible heat source is spaced apart from the aerosol-forming substrate.

In any of the above embodiments, the plurality of inwardly extending sharp teeth are preferably arranged in a pattern having a density of a least 3 teeth per square centimetre, for example from about 3 to about 50 teeth per square centimetre, preferably from about 7 to about 50 teeth per square centimetre, more preferably from about 13 to about 50 teeth per square centimetre, most preferably from about 20 to about 45 teeth per square centimetre.

In certain embodiments, the plurality of inwardly extending sharp teeth are arranged in a regular pattern. Throughout the specification, the term "regular pattern" is used to denote a pattern comprising a regular array of teeth. For example, the plurality of inwardly extending sharp teeth may be arranged in a regular striped pattern, a regular checked or square pattern, a regular hexagonal pattern or any other regular geometric pattern. In certain other embodiments, the plurality of inwardly extending sharp teeth are arranged in an irregular pattern. Throughout the specification, the term "irregular pattern" is used to denote a pattern comprising a non-repetitive or random array of teeth.

The plurality of inwardly extending sharp teeth preferably have a height, or in other words an inward extent, of from about 10 microns to about 2.25 millimetres, preferably from about 10 microns to about 1.5 millimetres, more preferably from about 10 microns to about 1 millimetre, most preferably from about 10 microns to about 0.5 millimetre.

The plurality of inwardly extending sharp teeth may grip the combustible heat source through direct contact between the teeth and the outer surface of the combustible heat source. Alternatively, or in addition, the plurality of inwardly extending sharp teeth may grip the combustible heat source through indirect contact between the teeth and the outer surface of the combustible heat source, via one or more intermediate components. For example, the plurality of inwardly extending sharp teeth may be arranged to indirectly grip the combustible heat source through direct contact with one or more components on the surface of the combustible heat source, such as one or more layers of glue or wrapper material on the outer surface of the combustible heat source.

The gripping means overlies at least a portion of the combustible heat source so that at least some of the plurality of inwardly extending sharp teeth grip the combustible heat source. The amount of the combustible heat source which is overplayed by the gripping means and, thus, the amount of the combustible heat source which is gripped by the plurality of inwardly extending sharp teeth may vary according to the specific arrangement of the teeth and of the smoking article itself.

In preferred embodiments, the plurality of inwardly extending sharp teeth grip the combustible heat source along at least about 25 percent of its length. In other words, the gripping means overlies the combustible heat source such that at least 25 percent of the length of the combustible heat source is gripped by the plurality of inwardly extending sharp teeth. For example, the gripping means may overlie the combustible heat source such that the plurality of inwardly extending sharp teeth grip the combustible heat source from its rear end face to a position at about 25 percent of the distance between the front and rear end faces of the combustible heat source. Alternatively, the gripping means may overlie the combustible heat source such that the plurality of inwardly extending sharp teeth grip the combustible heat source along two or more axially spaced lengths of the combustible heat source, the axially spaced lengths having a combined length of at least 25 percent of the length of the combustible heat source.

The gripping means may extend around only part of the circumference of the combustible heat source. In certain preferred embodiments, the gripping means extends around substantially the entire circumference of the combustible heat source. In such embodiments, the gripping means forms one or more rings around the combustible heat source.

The gripping means may be arranged so that it overlies only the combustible heat source. Alternatively, the gripping means may overlie other components of the smoking article so that those other components are also gripped by the plurality of inwardly extending sharp teeth. In certain embodiments, the gripping means overlies at least a portion of the aerosol-forming substrate such that at least some of the plurality of inwardly extending sharp teeth grip the aerosol-forming substrate. This may advantageously further improve the integrity of the smoking article and help to maintain a good thermal connection between the combustible heat source and aerosol-forming substrate during use by resisting movement of the combustible heat source and of the aerosol-forming substrate relative to each other and to the wrapper. This may help to keep the temperature of the aerosol-forming substrate within a desired range in order to improve the aerosol delivery to a user.

The plurality of inwardly extending sharp teeth may be formed from any suitable material or materials, for example aluminium, stainless steel film, titanium, nickel, or chromium. Preferably, the plurality of inwardly extending sharp teeth are formed from a material having an elastic modulus of at least about 100 GPa, preferably at least about 150 GPa. Advantageously, this allows the plurality of inwardly extending sharp teeth to be made smaller or thinner, or smaller and thinner, while still adequately gripping the combustible heat source. This means that a larger diameter combustible heat source can be used for a given smoking article diameter than may be possible with larger or thicker teeth. This may help the aerosol-forming substrate reach a desired temperature range to provide an acceptable aerosol. It may be particularly beneficial for smoking articles in which the plurality of inwardly extending sharp teeth are arranged on the inner surface of a heat-conducting element between the combustible heat source and the aerosol-forming substrate, since the clearance between the combustible heat source and the heat-conducting element may be reduced, leading to increased heat transfer between the combustible heat source and the heat-conducting element.

As used herein, the term "elastic modulus" refers to the Young's modulus of the material.

The plurality of inwardly extending sharp teeth are fixed to an inner surface of the wrapper. As used herein, the term "fixed" is used to mean that the plurality of inwardly extending sharp teeth are fastened to the wrapper either as an integral part of the wrapper, or non-integrally as one or more discrete components which are fastened to the wrapper directly or indirectly via one or more intermediate components. The plurality of inwardly extending sharp teeth may be arranged directly on the inner surface of the wrapper. Alternatively, or in addition, the plurality of inwardly extending sharp teeth may be arranged directly on the inner surface of a heat-conducting element between the wrapper and the combustible heat source. The plurality of inwardly extending sharp teeth arranged on the inner surface of the heat-conducting element may extend between the combustible heat source and the aerosol-forming substrate. In preferred embodiments, the plurality, of inwardly extending sharp teeth are arranged on the inner surface of at least one sheet fixed to the wrapper.

Where the plurality of inwardly extending sharp teeth are arranged on the inner surface of at least one sheet fixed to the wrapper, the at least one sheet may be fixed to the wrapper in any suitable manner. For example, by using glue. The at least one sheet may be fixed to the wrapper directly, or indirectly via one or more intermediate elements. In certain embodiments, the at least one sheet may form an integral part of the wrapper. For example, the wrapper may be a multi-layer composite, the inner layer of which is formed by the at least one sheet.

Where the plurality of inwardly extending sharp teeth are arranged on the inner surface of at least one sheet fixed to the wrapper, the plurality of inwardly extending sharp teeth may be formed from an additional material applied to the inner surface of the at least one sheet. In preferred embodiments, the plurality of inwardly extending sharp teeth are integral to the sheet. In such embodiments, at least some of the plurality of inwardly extending sharp teeth may be formed from a partially cut and inwardly bent portion of the sheet. Preferably, each of the plurality of inwardly extending sharp teeth is formed from a partially cut and inwardly bent portion of the sheet. In other words, each tooth is formed by cutting along an open-shaped cut line on the inner surface of the at least one sheet to define a partially cut portion of sheet delimited by the cut line, and plastically deforming the partially cut portion in an inward direction to define the tooth. The cut line, and thus the partially cut portion of sheet from which each tooth is formed, may have any suitable open shape, for example an I-shape, a V-shape, U-shape, or C-shape.

The cut line preferably extends through the thickness of the at least one sheet. Advantageously, this maximises the thickness of the tooth relative to the thickness of the at least one sheet, thus increasing the stiffness of the tooth and the gripping force exerted for a given thickness of sheet. Alternatively, the cut line may extend through only part of the thickness of the sheet. In such embodiments, the partially cut portion of the sheet delimited by the cut line may be gouged from the inner surface of the sheet and inwardly deformed to form each tooth.

In certain preferred embodiments, the at least one sheet comprises a plurality of outwardly extending sharp teeth arranged on its outer surface to fix the at least one sheet to the wrapper. Advantageously, the plurality of outwardly extending sharp teeth grip the inner surface of the wrapper, or the inner surface of one or more intermediate components between the at least one sheet and the wrapper, so that the at least one sheet may be fixed to the wrapper without the need for adhesive. Preferably, the plurality of outwardly extending sharp teeth are substantially the same as the plurality of inwardly extending sharp teeth, described above. The plurality of outwardly extending sharp teeth may extend from the outer surface of the sheet in a substantially transverse direction. Alternatively, or in addition, at least some of the plurality of outwardly extending sharp teeth may extend towards a downstream end of the smoking article. Preferably, at least some of the plurality of outwardly extending sharp teeth extend towards an upstream end of the smoking article. Advantageously, by extending towards an upstream end of the smoking article, the plurality of outwardly extending sharp teeth can act as barbs to increase resistance against upstream movement of the at least one sheet relative to the wrapper, and thus upstream movement of the combustible heat source relative to the wrapper.

Where the at least one sheet comprises a plurality of outwardly extending sharp teeth arranged on its outer surface to fix the at least one sheet to the wrapper, the plurality of outwardly extending sharp teeth may be formed from an additional material applied to the outer surface of the at least one sheet. In preferred embodiments, the plurality of outwardly extending sharp teeth are each formed from a partially cut and outwardly bent portion of the sheet. In other words, each tooth is formed by cutting along an open-shaped cut line on the outer surface of the at least one sheet to define a partially cut portion of sheet delimited by the cut line, and plastically deforming the partially cut portion in an outward direction to define the tooth. The cut line, and thus the partially cut portion of sheet from which each tooth is formed, may have any suitable open shape, for example an I-shape, a V-shape, U-shape, or C-shape.

In certain embodiments, the plurality of inwardly extending sharp teeth are arranged on the inner surface of at least one sheet fixed to the wrapper, wherein the at least one sheet further comprises a plurality of outwardly extending sharp teeth arranged on its outer surface to fix the at least one sheet to the wrapper. In such embodiments, at least some of both the plurality of inwardly extending sharp teeth and the plurality of outwardly extending sharp teeth may be integral to the sheet, for example, formed from partially cut and bent portion of the sheet. Preferably, each of the plurality of inwardly extending sharp teeth and the plurality of outwardly extending sharp teeth are integral to the sheet, for example, formed from partially cut and bent portion of the sheet.

The cut line preferably extends through the thickness of the at least one sheet. Advantageously, this maximises the thickness of the tooth relative to the thickness of the at least one sheet, thus increasing the stiffness of the tooth and the gripping force exerted for a given thickness of sheet. Alternatively, the cut line may extend through only part of the thickness of the sheet. In such embodiments, the partially cut portion of the sheet delimited by the cut line may be gouged from the outer surface of the sheet and outwardly deformed to form each tooth.

The at least one sheet may be formed from any suitable material or materials, for example aluminium, stainless steel film, titanium, nickel, or chromium. Preferably, the at least one sheet is formed from a material having an elastic modulus of at least about 100 GPa, preferably at least about 150 GPa. By using a sheet with a relatively high elastic modulus, the plurality of outwardly extending sharp teeth can be made smaller or thinner, or smaller and thinner while still adequately gripping the wrapper.

In preferred embodiments, the at least one sheet is formed from stainless steel or hardened aluminium and has a thickness of at least about 0.05 mm, preferably at least about 0.1 mm, more preferably from about 0.1 mm to about 0.15 mm.

The plurality of inwardly extending sharp teeth may all be arranged on a single sheet fixed to the wrapper.

Alternatively, the plurality of inwardly extending sharp teeth may be arranged on the inner surface of a plurality of discrete sheets fixed to the wrapper. The discrete sheets may be directly adjacent to one another. Alternatively, two or more of the discrete sheets may be spaced apart in the axial or circumferential directions, or in both the axial and circumferential directions. This allows the gripping means to be positioned in selected locations along the length of the smoking article or around the circumference of the smoking article as required. This may reduce the manufacturing costs by reducing the amount of sheet material required.

Where the plurality of inwardly extending sharp teeth are arranged on the inner surface of a plurality of discrete sheets fixed to the wrapper, the discrete sheets may be in any suitable arrangement. For example, one or more of the sheets may extend around substantially the entire circumference of the combustible heat source and be axially spaced from other sheets, which may or may not also extend around substantially the entire circumference of the combustible heat source. In certain embodiments, the sheets may extend around only part of the circumference of the combustible heat source and be spaced in the circumferential direction.

In any of the above embodiments, the aerosol-forming substrate may abut the rear face of the combustible heat source. Advantageously, the gripping means can retain the combustible heat source in direct contact with the aerosol-forming substrate during use to ensure a good thermal connection between the two components and to maintain the temperature of the aerosol-forming substrate within a desired range. In certain embodiments, the combustible heat source and the aerosol-forming substrate are in abutting coaxial alignment.

As used herein, the terms “abutting” and “abut” are used to describe the aerosol-forming substrate being in direct contact with the rear face of the combustible heat source, or a non-combustible substantially air impermeable first barrier coating provided on the rear face of the combustible heat source, or an air permeable coating provided on the rear face of the combustible heat source.

In other embodiments, the aerosol-forming substrate may be spaced apart from the rear face of the combustible heat source. That is, there may be a space or gap between the aerosol-forming substrate and the rear face of the combustible heat source. In such embodiments, the aerosol-forming substrate may be spaced apart from the rear face of the combustible heat source by a cavity or by a spacer material, such as an air permeable spacer material, or by a cavity and a spacer material.

Where the plurality of inwardly extending sharp teeth are arranged on the inner surface of at least one sheet fixed to the wrapper, the at least one sheet may circumscribe at least a rear portion of the combustible heat source and at least a front portion of the aerosol-forming substrate such that it forms a heat-conducting element between the combustible heat source and the aerosol-forming substrate. In such embodiments, the sheet provides a thermal link between the combustible heat source and the aerosol-forming substrate and advantageously helps to facilitate adequate heat transfer from the combustible heat source to the aerosol-forming substrate to provide an acceptable aerosol.

The combustible heat source is preferably a solid heat source, and may comprise any suitable combustible fuel including, but not limited to, carbon and carbon-based materials containing aluminium, magnesium, one or more carbides, one or more nitrides and combinations thereof. Solid combustible heat sources for heated smoking articles and methods for producing such heat sources are known in the art and described in, for example, U.S. Pat. Nos. 5,040,552 and 5,595,577. Typically, known solid combustible heat sources for heated smoking articles are carbon-based, that is they comprise carbon as a primary combustible material.

The combustible heat source is preferably a blind combustible heat source. As used herein, the term 'blind' describes a heat source that does not comprise any air flow channels extending from the front end face to the rear end face of the combustible heat source. As used herein, the term 'blind' is also used to describe a combustible heat source including one or more airflow channels extending from the front end face of the combustible heat source to the rear end face of the combustible heat source, wherein a combustible substantially air impermeable barrier between the rear end face of the combustible heat source and the aerosol-forming substrate barrier prevents air from being drawn along the length of the combustible heat source through the one or more airflow channels.

Smoking articles according to the invention comprising blind combustible heat sources comprise one or more air inlets downstream of the rear end face of the combustible heat source for drawing air into the one or more airflow pathways. Smoking articles according to the invention comprising non-blind combustible heat sources may also comprise one or more air inlets downstream of the rear end face of the combustible heat source for drawing air into the one or more airflow pathways.

In certain preferred embodiments, smoking articles according to the invention comprising blind combustible heat sources comprise one or more air inlets located proximate to the downstream end of the aerosol-forming substrate.

In use, air drawn along the one or more airflow pathways of smoking articles according to the invention comprising a blind combustible heat source for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through smoking articles according to the invention during use thereof. This is particularly advantageous where the blind combustible heat source comprises one or more additives to aid ignition or combustion of the blind combustible heat source.

In smoking articles according to the invention comprising a blind combustible heat source, heat transfer from the blind combustible heat source to the aerosol-forming substrate occurs primarily by conduction and heating of the aerosol-forming substrate by forced convection is minimised or reduced. This may advantageously helps to minimise or reduce the impact of a user's puffing regime on the composition of the mainstream aerosol of smoking articles according to the invention.

In smoking articles according to the invention comprising a blind combustible heat source, it is particularly important to optimise the conductive heat transfer between the combustible heat source and the aerosol-forming substrate. As described further below, the inclusion of one or more heat-conducting elements around at least a rear portion of the combustible carbonaceous heat source and at least a front portion of the aerosol-forming substrate is particularly preferred in smoking articles according to the invention including blind heat sources, where there is little if any heating of the aerosol-forming substrate by forced convection.

It will be appreciated that smoking articles according to the invention may comprise blind combustible heat sources comprising one or more closed or blocked passageways through which air may not be drawn for inhalation by a user.

For example, smoking articles according to the invention may comprise blind combustible heat sources comprising one or more closed passageways that extend from the front end face at the upstream end of the blind combustible carbonaceous heat source only part way along the length of the blind combustible carbonaceous heat source.

The inclusion of one or more closed air passageways increases the surface area of the blind combustible heat source that is exposed to oxygen from the air and may advantageously facilitate ignition and sustained combustion of the blind combustible heat source.

In certain embodiments of the invention, the combustible heat source comprises at least one longitudinal airflow channel, which provides one or more airflow pathways through the heat source. The term "airflow channel" is used herein to describe a channel extending along the length of the heat source through which air may be drawn through the smoking article for inhalation by a user. Such heat sources including one or more longitudinal airflow channels are referred to herein as "non-blind" heat sources.

The diameter of the at least one longitudinal airflow channel may be between about 1.5 mm and about 3 mm, more preferably between about 2 mm and about 2.5 mm. The inner surface of the at least one longitudinal airflow channel may be partially or entirely coated, as described in more detail in WO-A-2009/022232.

As used herein, the term "aerosol-forming substrate" is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise one or more aerosol formers. Examples of suitable aerosol formers include, but are not limited to, glycerine and propylene glycol.

In some embodiments, the aerosol-forming substrate is a rod comprising a tobacco-containing material.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghetti strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

The aerosol-forming substrate preferably has a length of between about 5 mm and about 20 mm. In certain embodiments, the aerosol-forming substrate may have a length of between about 6 mm and about 15 mm or a length of between about 7 mm and about 12 mm.

In preferred embodiments, the aerosol-forming substrate comprises a plug of tobacco-based material wrapped in a plug wrap. In particularly preferred embodiments, the aerosol-forming substrate comprises a plug of homogenised tobacco-based material wrapped in a plug wrap.

Smoking articles according to the invention may comprise a heat-conducting element around and in direct contact with both at least a rear portion of the combustible heat source and at least a front portion of the aerosol-forming substrate. In such embodiments, the heat-conducting element provides a thermal link between the combustible heat source and the aerosol-forming substrate of smoking articles according to the invention and advantageously helps to facilitate adequate heat transfer from the combustible heat source to the aerosol-forming substrate to provide an acceptable aerosol.

Alternatively or in addition, smoking articles according to the invention may comprise a heat-conducting element spaced apart from one or both of the combustible heat source and the aerosol-forming substrate, such that there is no direct contact between the heat-conducting element and one or both of the combustible heat source and the aerosol-forming substrate.

Where the smoking article comprises a heat-conducting element around at least a rear portion of the combustible heat source and at least a front portion of the aerosol-forming substrate, the heat-conducting element may be formed by at least one sheet of the gripping means. Alternatively, or in addition, the at least one sheet of the gripping means may be provided on an inner surface of the heat-conducting element so that the at least one sheet is fixed to the wrapper via the heat-conducting element.

The one or more heat-conducting elements are preferably non-combustible. In certain embodiments, the one or more heat conducting elements may be oxygen restricting. In other words, the one or more heat-conducting elements may inhibit or resist the passage of oxygen through the heat-conducting element.

Suitable heat-conducting elements for use in smoking articles according to the invention include, but are not limited toy metal foil wrappers such as, for example, aluminium foil wrappers, steel wrappers, iron foil wrappers and copper foil wrappers; and metal alloy foil wrappers.

Smoking articles according to the invention may further comprise a cap configured to at least partially cover the front end face of the combustible heat source, wherein the cap is removable to expose the front end face of the combustible heat source prior to use of the smoking article.

As used herein, the term 'cap' refers to a protective cover that substantially surrounds the distal end of the smoking article, including the front end face. Providing a cap that is removed prior to ignition of the smoking article advantageously protects the combustible heat source prior to use.

For example, smoking articles according to the invention may comprise a removable cap attached at a line of weakness to the distal end of the smoking article, wherein the cap comprises a cylindrical plug of material circumscribed by a wrapper as described in WO-A1-2014/086998.

Smoking articles according to the invention preferably comprise a mouthpiece located at the proximal end thereof.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

The smoking article may comprise a transfer element, or spacer element, between the aerosol-forming substrate and the mouthpiece. Such an element may take the form of a hollow tube that is located downstream of an aerosol-forming substrate.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible carbonaceous heat source to the aerosol forming substrate. The inclusion of a transfer element also advantageously allows the overall length of the smoking article to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and, length of other components within the smoking article.

Preferably, the transfer element comprises at least one open-ended tubular hollow body. In such embodiments, in use, air drawn into the smoking article passes through the at least one open-ended tubular hollow body as it passes downstream through the smoking article from the aerosol-forming substrate to the mouthpiece.

The transfer element may comprise at least one open-ended tubular hollow body formed from One or more suitable materials that are substantially thermally stable at the temperature of the aerosol generated by the transfer of heat from the combustible carbonaceous heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention comprise a wrapper that circumscribes the aerosol-forming substrate and at least a rear portion of the combustible heat source. In preferred embodiments, smoking articles according to the invention comprise an outer wrapper that circumscribes the aerosol-forming substrate, at least a rear portion of the combustible carbonaceous heat source and any other components of the smoking article downstream of the aerosol-forming substrate.

Smoking articles according to the invention may comprise outer wrappers formed from any suitable material or combination of materials. Suitable materials are well known in the art and include, but are not limited to, cigarette paper. Alternatively or in addition, the mouthpiece may be circumscribed by tipping paper.

Smoking articles according to the invention may be arranged for insertion into a reusable holder having a mouthpiece. In such examples, the aerosol-forming substrate may be located at the downstream end of the smoking article. Such a smoking article may comprise the combustible heat source, aerosol forming substrate and wrapper. Other components may be provided for example as a part of the reusable holder. In other examples, the smoking article may comprise one or more additional components, such as a transfer element, aerosol-cooling element, or filter segment downstream of the aerosol-forming substrate. For example, such additional components may be insertable into the reusable holder. In examples in which the smoking article is arranged for insertion into a reusable holder having a mouthpiece, the smoking article may have a total length of between approximately 10 mm and approximately 100 mm The smoking article may be substantially cylindrical in shape. The smoking article may be substantially elongate. The smoking article has a length and a circumference substantially perpendicular to the length.

The aerosol-forming substrate may be substantially cylindrical in shape. The aerosol-forming substrate may be substantially elongate. The aerosol-forming substrate also has a length and a circumference substantially perpendicular to the length. The aerosol-forming substrate may be located in the smoking article such that the length of the aerosol-forming substrate is substantially parallel to the airflow direction in the smoking article.

The transfer section or element may be substantially elongate.

Smoking articles according to the invention may have any desired length. For example, smoking articles according to the invention may have a total length of between approximately 65 mm and approximately 100 mm.

Smoking articles according to the invention may have any desired external diameter. For example, smoking articles according to the invention may have an external diameter of between approximately 5 mm and approximately 12 mm.

Smoking articles according to the invention may be assembled using known methods and machinery.

All scientific and technical terms used herein have meanings commonly used in the art unless otherwise specified. The definitions provided herein are to facilitate understanding of certain terms used frequently herein.

The terms 'preferred' and 'preferably' refer to embodiments of the invention that may afford certain benefits, under certain circumstances. Particularly preferred are smoking articles, combustible carbonaceous heat source assemblies and methods of manufacturing combustible carbonaceous heat source assemblies according to the invention comprising combinations of preferred features. However, it will be appreciated that other embodiments may also be preferred, under the same or other circumstances. Furthermore, the recitation of one or more preferred embodiments does not imply that other embodiments are not useful, and is not intended to exclude other embodiments from the scope of the claims.

The invention will be further described, by way of example only, with reference to the accompanying drawings in which.

Figure 1:
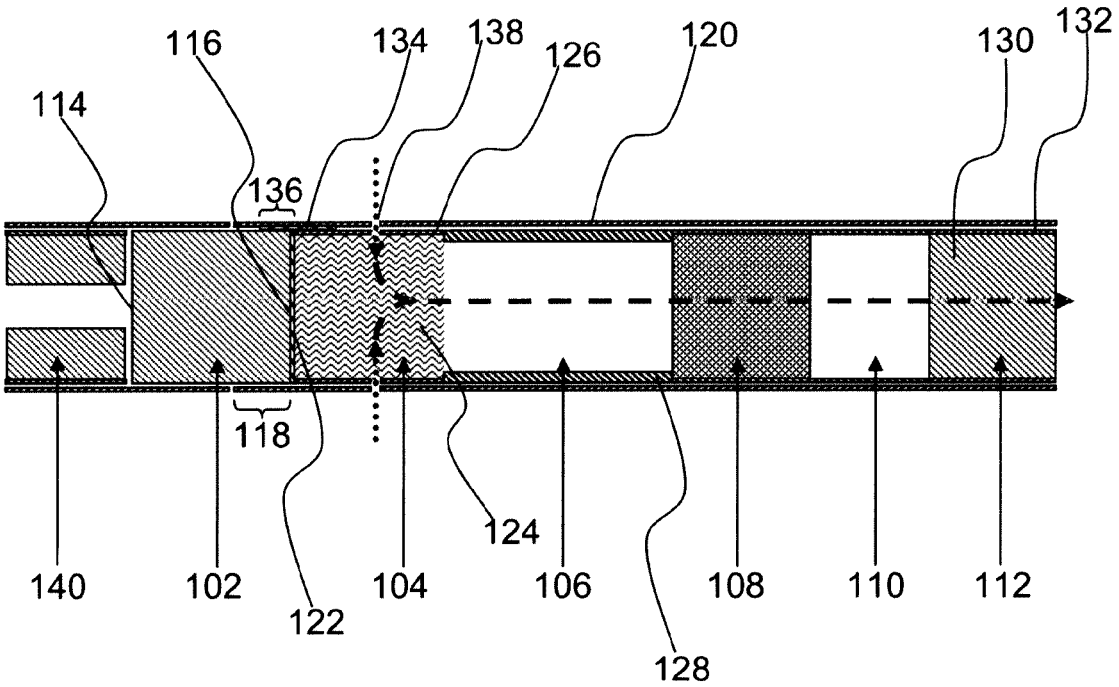
FIG. 1 shows a schematic longitudinal cross-sectional view of a first embodiment of smoking article according to the present invention.

The smoking article 100 according to the first embodiment of the invention shown in FIG. 1 comprises a combustible carbonaceous heat source 102, an aerosol-forming substrate 104, a transfer element 106, an aerosol-cooling element 108, a spacer element 110 and a mouthpiece 112 in abutting coaxial alignment. The combustible carbonaceous heat source 102 has a front end face 114 and an opposed rear end face 116. As shown in FIG. 1, the aerosol-forming substrate 104, transfer element 106, aerosol-cooling element 108, spacer element 110 and mouthpiece 112 and a rear portion 118 of the blind combustible heat source 102 are wrapped in an outer wrapper 120 of sheet material such as, for example, cigarette paper.

The combustible carbonaceous heat source 102 is a blind carbonaceous combustible heat source and is located at the distal end of the smoking article 100. As shown in FIG. 1, a non-combustible substantially air impermeable barrier 122 in the form of a disc of aluminium foil is provided between the rear end face 116 of the combustible carbonaceous heat source 102 and the aerosol-forming substrate 104. The barrier 122 is applied to the rear end face 116 of the combustible carbonaceous heat source 102 by pressing the disc of aluminium foil onto the rear end face 116 of the combustible carbonaceous heat source 102 and abuts the rear end face 116 of the combustible carbonaceous heat source 102 and the aerosol-forming substrate 104.

The aerosol-forming substrate 104 is located immediately downstream of the barrier 122 applied to the rear end face 116 of the combustible carbonaceous heat source 102. The aerosol-forming substrate 104 comprises a cylindrical plug of homogenised tobacco-based material 124 including an aerosol former such as, for example, glycerine, wrapped in plug wrap 126.

The transfer element 106 is located immediately downstream of the aerosol-forming substrate 104 and comprises a cylindrical open-ended hollow cellulose acetate tube 128.

The aerosol-cooling element 108 is located immediately downstream of the transfer element 106 and comprises a gathered sheet of biodegradable polymeric material such as, for example, polylactic acid.

The spacer element 110 is located immediately downstream of the aerosol-cooling element 108 and comprises a cylindrical open-ended hollow paper or cardboard tube.

The mouthpiece 112 is located immediately downstream of the spacer element 110. As shown in FIG. 1, the mouthpiece 112 is located at the proximal end of the smoking article 100 and comprises a cylindrical plug of suitable filtration material 130 such as, for example, cellulose acetate tow of very low filtration efficiency, wrapped in filter plug wrap 132.

The smoking article may further comprise a band of tipping paper (not shown) circumscribing a downstream end portion of the outer wrapper 120.

The smoking article may further comprise a removable cap 140 at its distal end and directly adjacent to the heat source 102. For example, the removable cap may comprise a central portion including a desiccant, such as glycerine, to absorb moisture as compared to the heat source, which is wrapped in a portion of the outer wrapper 120 and connected to the rest of the outer wrapper 120 along a line of weakness 142 comprising a plurality of perforations in the outer wrapper that circumscribe the smoking article. To use the smoking article, the user removes the removable cap by transversely compressing the cap by pinching it between thumb and finger. By compressing the cap, sufficient force is provided to the line of weakness to locally break the outer wrapper. The user then removes the cap by twisting the cap to break the remaining portion of the line of weakness. When the cap is removed the heat source is partially exposed which enables the user to light the smoking article.

As shown in FIG. 1, the smoking article further comprises gripping means 134 overlying and in direct contact with a gripped portion 136 of the combustible heat source 102 and fixed to an inner surface of the outer wrapper 120, as discussed in more detail below. In the embodiment shown in FIG. 1, the gripping means is also in contact with a front portion of the aerosol-forming substrate 104. However, it will be appreciated that in other embodiments of the invention (not shown), the gripping means 134 may overlie and contact more or less of the combustible heat source 102 and the aerosol-forming substrate 104. For example, the gripping means may extend to or beyond the upstream end of the outer wrapper 120 to contact more of the length of the combustible heat source 102.

The smoking article may also comprise a heat-conducting element (not shown) of suitable material such as, for example, aluminium foil, around and in direct contact with a rear portion of the combustible heat source and a front portion of the aerosol-forming substrate. The aerosol-forming substrate may extend downstream beyond the heat-conducting element. That is, the heat-conducting element may be arranged such that it is not around and in direct contact with a rear portion of the aerosol-forming substrate. Alternatively, the heat-conducting element may be around and in contact with the entire length of the aerosol-forming substrate. It will be appreciated that in other embodiments of the invention (not shown), one or more additional heat-conducting elements may be provided that overlie the heat-conducting element. Where the smoking article comprises a heat-conducting element, the gripping means may be provided on an inner surface of the heat-conducting element and fixed to the outer wrapper via the heat-conducting element. Alternatively, the heat-conducting element may be formed by the gripping means.

The smoking article 100 according to the first embodiment of the invention comprises one or more air inlets 138 around the periphery of the aerosol-forming substrate 104. As shown in FIG. 1, a circumferential, arrangement of air inlets 138 is provided in the plug wrap 126 of the aerosol-forming substrate 104 and the overlying outer wrapper 120 to admit cool air (shown by dotted arrows in FIG. 1) into the aerosol-forming substrate 104.

In use, the user ignites the combustible heat source 102 which heats the aerosol-forming substrate 104 to produce an aerosol. When the user inhales on the mouthpiece 110 air (shown by dotted arrows in FIG. 1) is drawn into the aerosol-forming substrate 104 through the air inlets 138.

The front portion of the aerosol-forming substrate 104 is heated by conduction through the rear end face 116 of the combustible carbonaceous heat source 104, and the barrier 122, and, where applicable, the gripping means and the heat-conducting element (not shown).

The heating of the aerosol-forming substrate 104 by conduction releases glycerine and other volatile and semi-volatile compounds from the plug of homogenised tobacco-based material 124. The compounds released from the aerosol-forming substrate 104 form an aerosol that is entrained in the air drawn into the aerosol-forming substrate 104 of the smoking article 100 through the air inlets 138 as it flows through the aerosol-forming substrate 104. The drawn air and entrained aerosol (shown by dashed arrows in FIG. 1) pass downstream through the interior of the cylindrical open-ended hollow cellulose acetate tube 128 of the transfer element 106, the aerosol-cooling element 108 and the spacer element 110, where they cool and condense. The cooled drawn air and entrained aerosol pass downstream through the mouthpiece 112 and are delivered to the user through the proximal end of the smoking article 100. The non-combustible substantially air impermeable barrier 122 on the rear end face 116 of the combustible carbonaceous heat source 102 isolates the combustible carbonaceous heat source 102 from air drawn through the smoking article 100 such that, in use, air drawn through the smoking article 100 does not come into direct contact with the combustible carbonaceous heat source 102.

Figure 2:
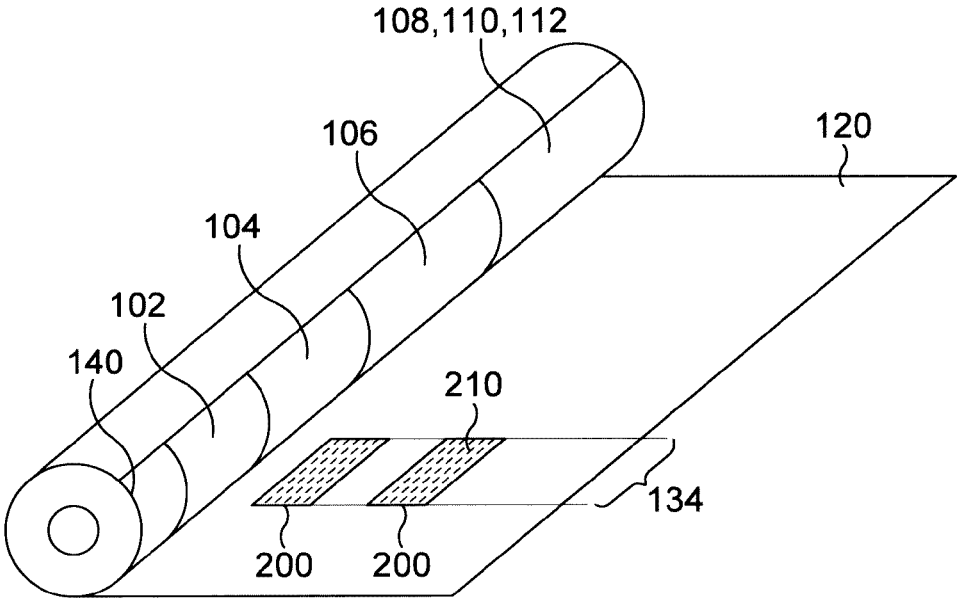
FIG. 2 shows a schematic perspective view of the smoking article of FIG. 1, in which the outer wrapper is partially unwrapped to show internal components.
Figure 3:
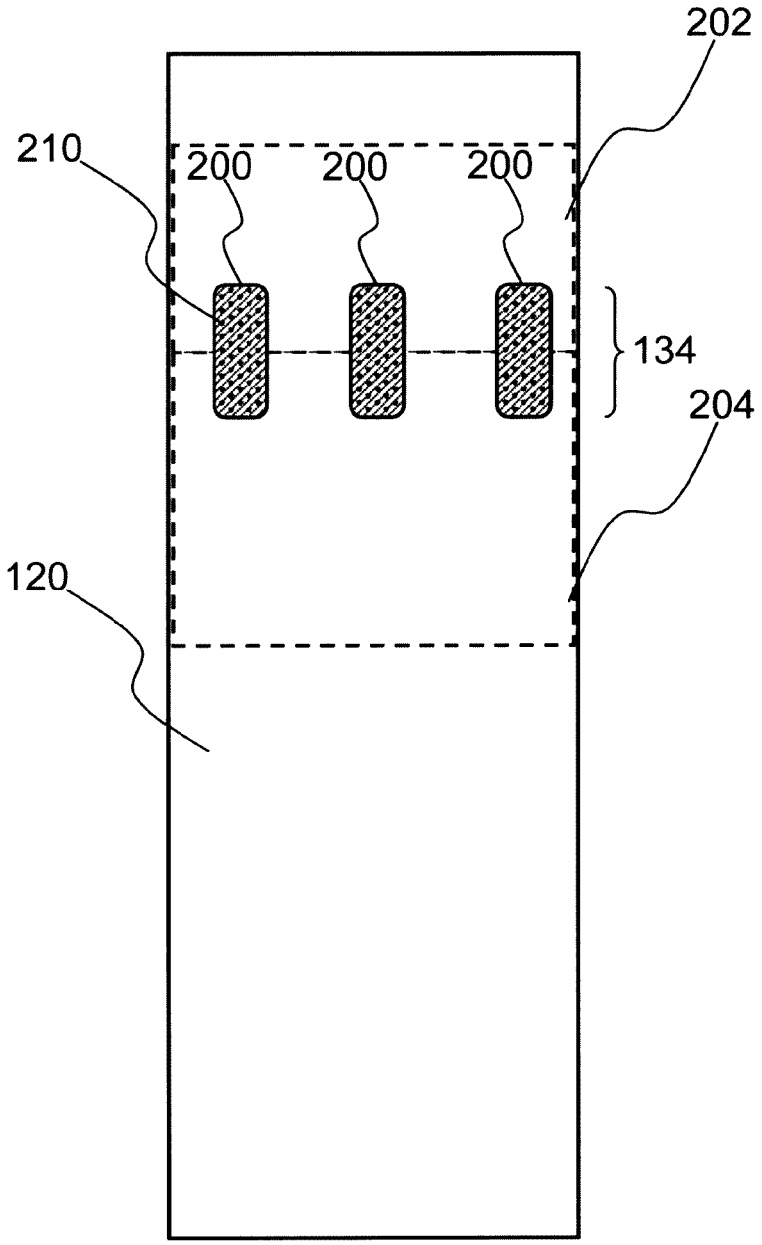
FIG. 3 shows a schematic plan view of the outer wrapper of the smoking article of FIG. 1, showing the outer wrapper in an unwrapped, flat condition.

Referring to FIGS. 2 and 3, the gripping means 134 comprises three discrete sheets 200 of suitable material such as, for example, stainless steel, fixed to the inner surface of the outer wrapper 120. Each sheet 200 has a plurality of inwardly extending sharp teeth 210 for gripping the combustible heat source 102 extending from its inner surface. Each sheet 200 also has a plurality of outwardly extending sharp teeth (not shown) extending from its outer surface by which the sheet is fixed to the inner surface of the outer wrapper 120. The plurality of outwardly extending sharp teeth may be substantially the same as the plurality of inwardly extending sharp extending teeth, as described below. In the embodiment shown in FIGS. 2 and 3, the discrete sheets 200 are substantially aligned in the axial direction and spaced apart in the circumferential direction of the smoking article such that the gripping means 134 extends around only part of the circumference of the smoking article 100. However, it will be appreciated that in other embodiments of the invention (not shown), the gripping means may comprise fewer or more than three spaced apart sheets and that those sheets may be directly adjacent, or spaced apart in the circumferential direction, the axial direction, or the circumferential and axial directions. As shown in FIG. 3, the outer wrapper 120 defines a first section 202 which overlies the combustible heat source 102 and a second section 204 which overlies the aerosol-forming substrate 104. The sheets 200 are fixed to the first and second sections 202, 204 of the wrapper 120 such that the sheets 200 extend over approximately one third of the length of the first section 202 and such that the plurality of inwardly extending sharp teeth 210 grip approximately one third of the length of the combustible heat source 102.

Figure 4:
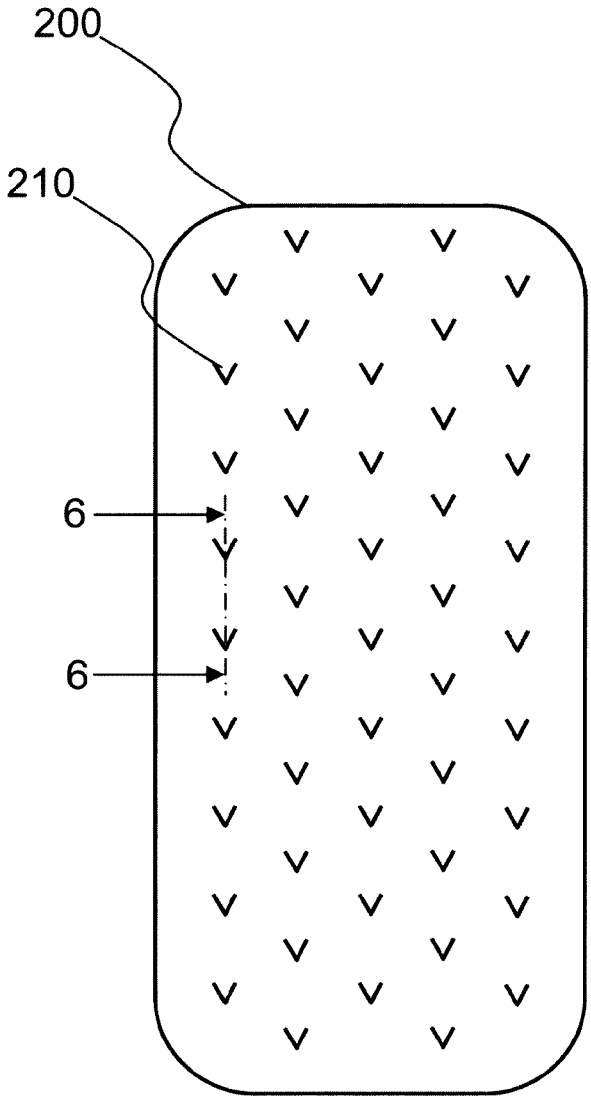
FIG. 4 shows an enlarged schematic plan view of a gripping means of the outer wrapper of FIG. 3.

Referring to FIG. 4, the plurality of inwardly extending sharp teeth 210 are arranged on each sheet 200 in a regular checked pattern with approximately 20 teeth per square centimetre. The sheet 200 has rounded corners to minimise the risk of damage to the outer wrapper 120.

Figure 5:
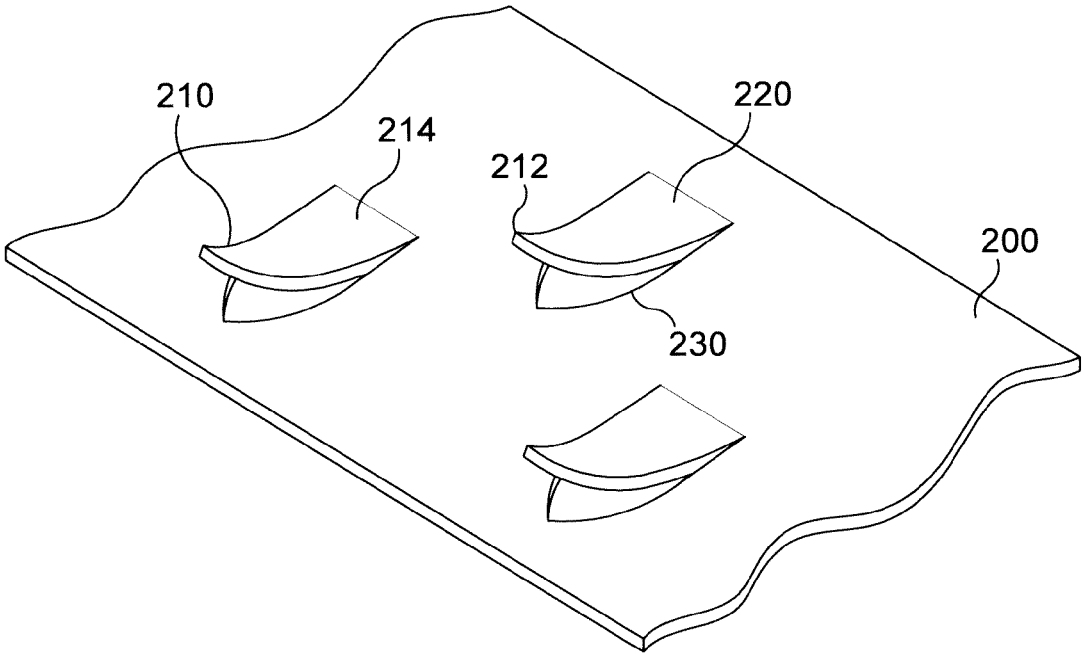
FIG. 5 shows a partial enlarged schematic perspective view of the plurality of inwardly extending sharp teeth of the gripping means of FIG. 5.
Figure 6:
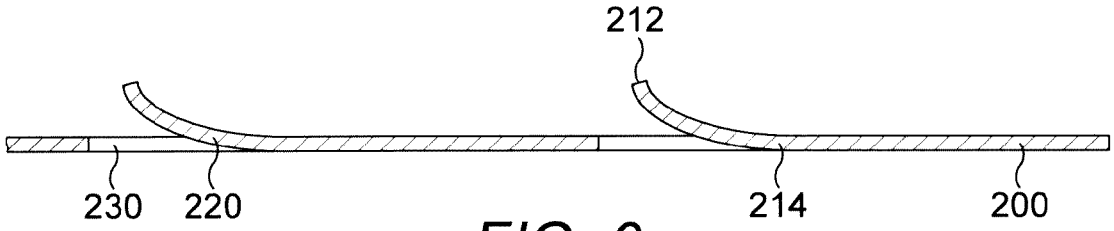
FIG. 6 shows a schematic longitudinal cross-sectional view of the gripping means of FIG. 4, taken through the line 6-6 in FIG. 4.

Referring to FIGS. 5 and 6, each tooth 210 is formed from a partially cut portion 220 of the sheet 200 delimited by a cut line 230 extending through the thickness of the sheet 200. The partially cut portion 220 is bent inwardly such that the tooth 210 extends from the inner surface of the sheet 200. The plurality of inwardly extending sharp teeth 210 are arranged on the sheet 200 such that the tip 212 of each tooth extends towards the downstream end of the smoking article 100. That is, the tip 212 of each tooth 210 is downstream of its base 214. In the embodiment shown in FIG. 6, the plurality of inwardly extending sharp teeth 210 have a curved profile, in the form of a shallow hook shape, in which the tip 212 extends from the inner surface of the sheet 200 in a substantially transverse direction. However, it will be appreciated that in other embodiments of the invention (not shown) one or more of the plurality of inwardly extending sharp teeth may have other non-linear, or linear profiles.

Figure 7:
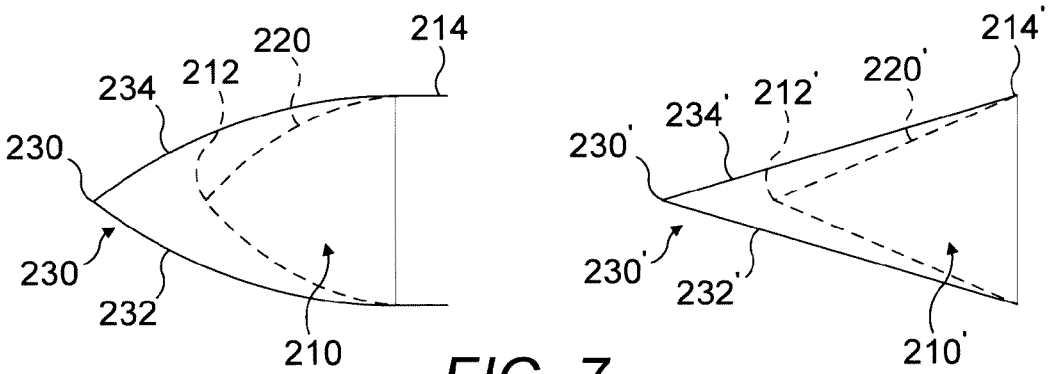
FIG. 7 is a partial schematic plan view of two alternative embodiments of inwardly extending sharp teeth.

As shown in FIG. 7, tooth 210 is formed from a partially cut portion 220 of sheet which is cut along a C-shaped cut line 230 extending through the thickness of the sheet 200. The cut line 230 comprises first and second cut lines 232, 234 which are curved and converge, or taper, from the base 214 of the tooth 210 to form an angular interface at the apex 236 of the cut line 230. The shape of the portion of sheet 220 from which the tooth 210 is formed corresponds to the shape of the cut line 230. Thus, tooth 210 has a sharp tip 212 formed by the converging curved cut lines 232, 234. However, it will be appreciated that in other embodiments of the invention, the cut line and the resulting tooth 210 may have a different shape. For example, tooth 210' in FIG. 7 is formed from a partially cut portion 220' of sheet which is cut along a V-shaped cut line 230' extending through the thickness of the sheet 200'. The cut line 230' comprises first and second cut lines 232', 234' which are linear and converge, or taper, from the base 214' of the tooth 210' to the apex 236' of the cut line 230'. In an alternative embodiment (not shown), the tooth may be formed by cutting through the sheet along a rounded, flat, or any other suitably shaped cut line to form a terminal edge which does not form an angular interface in the plane of the sheet but which forms an angular interface through its cross-section, in a similar manner to the cutting edge of a knife blade. In further alternative embodiments (not shown), the tooth may be formed from one of more surfaces of the sheet which converge in two dimensions to form a pointed tip.

Figure 8:
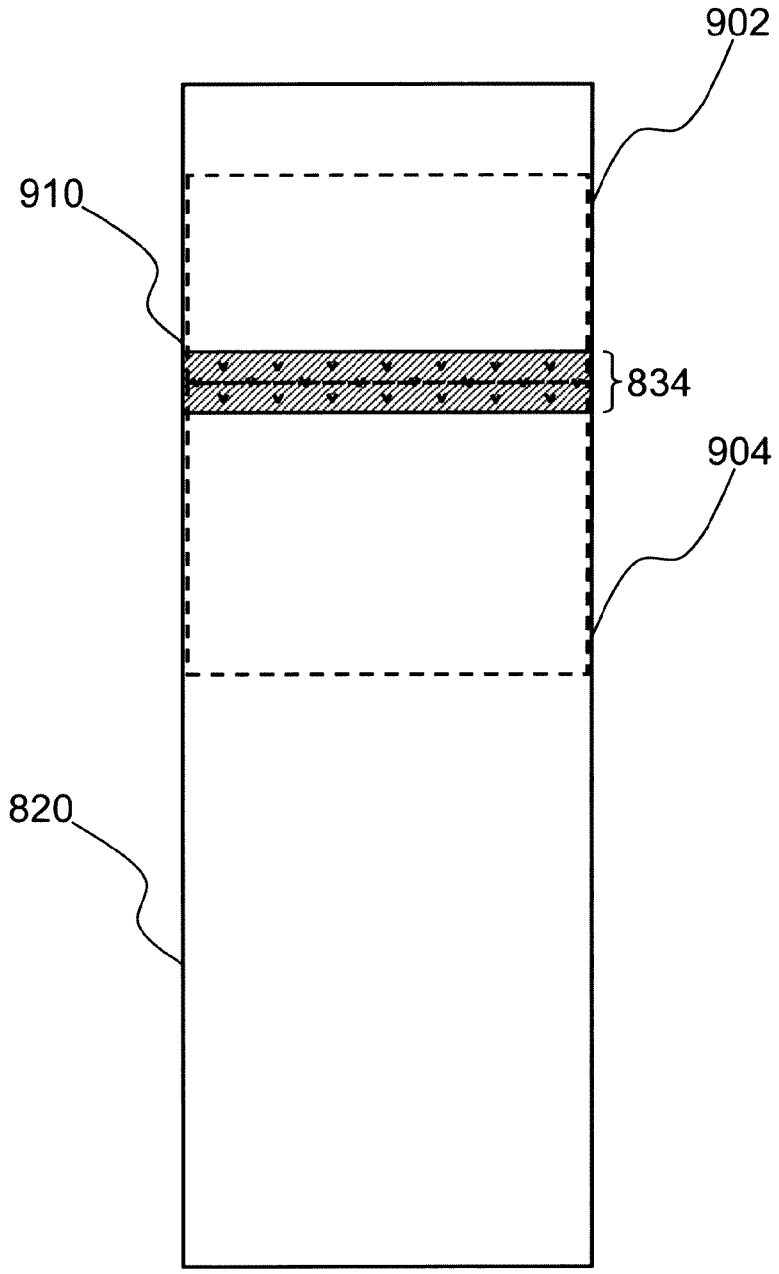
FIG. 8 shows a schematic plan view of the outer wrapper of a second embodiment of smoking article, showing the outer wrapper in an unwrapped, flat condition.
Figure 9:
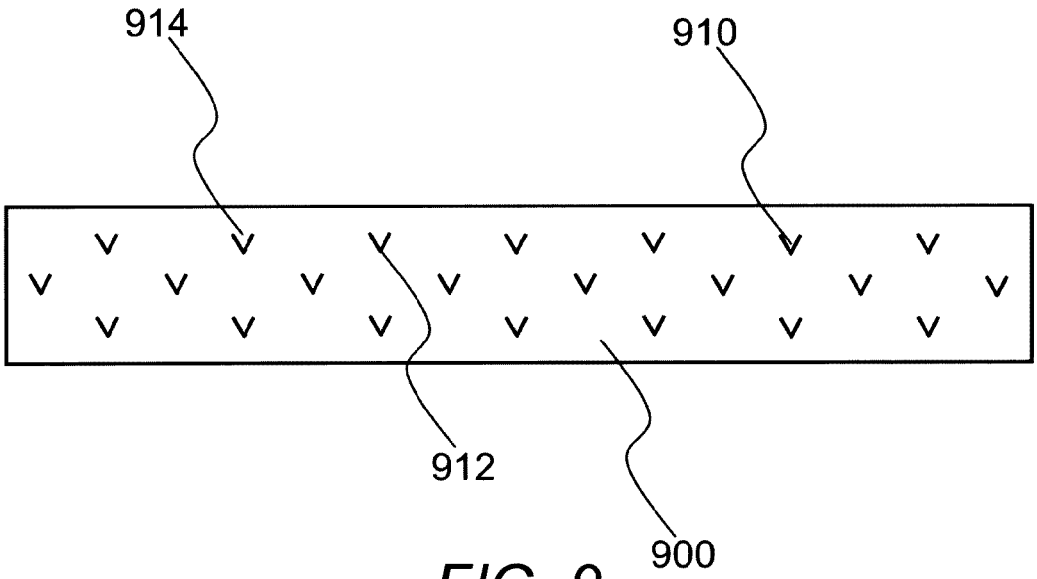
FIG. 9 shows an enlarged schematic plan view of a gripping means of the outer wrapper of FIG. 8.

FIGS. 8 and 9 show a second embodiment of gripping means 834. The gripping means 834 according to the second embodiment is of similar construction to the gripping means 134 according to the first embodiment shown in FIGS. 2 to 7. However, as shown in FIG. 8, in the second embodiment of gripping means 834 comprises a single sheet 900 of suitable material such as, for example, stainless steel, fixed to the inner surface of the outer wrapper 820 such that it extends across the entire width of the outer wrapper 820. With this arrangement, the gripping means 834 extends around the entire circumference of the smoking article. As with the gripping means 134 according to the first embodiment, sheet 900 has a plurality of inwardly extending sharp teeth 910 for gripping the combustible heat source extending from its inner surface and has a plurality of outwardly extending sharp teeth (not shown) extending from its outer surface by which the sheet is fixed to the inner surface of the outer wrapper 820. The plurality of inwardly extending pointed teeth 910 are substantially the same as those described above in relation to the first embodiment of gripping means. As shown in FIG. 8, the outer wrapper 820 defines a first section 802 which overlies the combustible heat source and a second section 804 which overlies the aerosol-forming substrate. The sheet 900 is fixed to the first and second sections 802, 804 of the wrapper 820 such that it extends over approximately one third of the length of the first section 802 and such that the plurality of inwardly extending sharp teeth 910 grip approximately one third of the length of the combustible heat source.

Referring to FIG. 9, the plurality of inwardly extending sharp teeth 910 are arranged on the sheet 900 in a regular checked pattern with approximately 20 teeth per square centimetre. The sheet 900 has rounded corners to minimise the risk of damage to the outer wrapper. As with the teeth 210 of the first embodiment, the plurality of inwardly extending sharp teeth 910 are arranged on the sheet 900 such that the tip 912 of each tooth extends towards the downstream end of the smoking article 100. That is, the tip 912 of each tooth 910 is downstream of its base 914.

The specific embodiments and examples described above illustrate but do not limit the invention. It is to be understood that other embodiments of the invention may be made and the specific embodiments and examples described herein are not exhaustive.

The invention claimed is:

1. A smoking article, comprising:

a combustible heat source;

an aerosol-forming substrate downstream of the combustible heat source;

a wrapper circumscribing the aerosol-forming substrate and at least a rear portion of the combustible heat source; and gripping means on the wrapper for gripping the combustible heat source, the gripping means comprising a plurality of inwardly extending sharp teeth fixed to an inner surface of the wrapper and arranged to grip the combustible heat source.

2. The smoking article according to claim 1, wherein the plurality of inwardly extending sharp teeth are pointed.

3. The smoking article according to claim 1, wherein at least some of the inwardly extending sharp teeth extend towards a downstream end of the smoking article.

4. The smoking article according to claim 1, wherein tips of at least some of the inwardly extending sharp teeth extend in a substantially transverse direction.

5. The smoking article according to claim 1, wherein the plurality of inwardly extending sharp teeth are arranged in a pattern having a density of from about 3 teeth to about 50 teeth per square cm.

6. The smoking article according to claim 1, wherein the plurality of inwardly extending sharp teeth are arranged in a pattern having a density of from about 20 to about 40 teeth per square cm.

7. The smoking article according to claim 1, wherein the plurality of inwardly extending sharp teeth grip the combustible heat source along at least about 25 percent of a length of the combustible heat source.

8. The smoking article according to claim 1, wherein the gripping means extends around substantially an entire circumference of the combustible heat source.

9. The smoking article according to claim 1, wherein the gripping means overlies at least a portion of the aerosol-forming substrate such that at least some of the inwardly extending pointed teeth grip the aerosol-forming substrate.

10. The smoking article according to claim 1, wherein the plurality of inwardly extending pointed teeth are formed from a material having an elastic modulus of at least about 100 GPa.

11. The smoking article according to claim 1, wherein the plurality of inwardly extending pointed teeth are arranged on an inner surface of at least one sheet fixed to the wrapper.

12. The smoking article according to claim 11, wherein the at least one sheet comprises a plurality of outwardly extending pointed teeth arranged on an outer surface of the at least one sheet, which fix the at least one sheet to the wrapper.

13. The smoking article according to claim 12, wherein at least some of the outwardly extending pointed teeth extend towards an upstream end of the smoking article.

14. The smoking article according to claim 11, wherein each of the plurality of inwardly extending pointed teeth, or the outwardly extending pointed teeth, or the inwardly extending pointed teeth and the outwardly extending pointed teeth, is formed from a partially cut and bent portion of the at least one sheet.

15. The smoking article according to claim 11, wherein the at least one sheet has a thickness of at least about 0.1 mm, preferably from about 0.1 mm to about 0.15 mm.

16. The smoking article according to claim 11, wherein the at least one sheet has a thickness of about 0.1 mm to about 0.15 mm.

17. The smoking article according to claim 11, wherein the at least one sheet circumscribes at least a rear portion of the combustible heat source and at least a front portion of the aerosol-forming substrate such that the at least one sheet forms a heat-conducting element between the combustible heat source and the aerosol-forming substrate.

* * * * *